United States Patent [19]

Thomas

[11] Patent Number: 4,911,448

[45] Date of Patent: Mar. 27, 1990

[54] SPINNER DEVICE

[76] Inventor: Benny Thomas, 2000 Grammet Dr. Apt. 1707, Shreveport, La. 71107

[21] Appl. No.: 393,276

[22] Filed: Aug. 14, 1989

[51] Int. Cl.[4] ..... A63F 5/04

[52] U.S. Cl. ..... 273/142 R; 368/95

[58] Field of Search ..... 273/142 R, 142 A, 142 B, 273/142 R, 142 J, 142 JA, 142 JB, 142 JC, 142 JD, 272, 299; 368/3, 10, 95

[56] References Cited

U.S. PATENT DOCUMENTS

| | | | |
|---|---|---|---|
| 136,048 | 2/1873 | Elliott . | |
| 1,060,998 | 5/1913 | Moss . | |
| 1,261,915 | 4/1918 | Ferdon | 368/95 |
| 1,541,707 | 6/1925 | Hanback . | |
| 1,837,194 | 12/1931 | Baumgarten | 273/142 JA |
| 2,166,335 | 7/1939 | Banner | 273/142 R |
| 2,626,156 | 1/1953 | Bergh | 273/142 R |
| 2,722,425 | 11/1955 | Gazelle | 273/142 R |
| 2,831,691 | 4/1958 | Vince . | |
| 3,163,426 | 12/1964 | Ruderian . | |
| 3,226,122 | 12/1965 | Rogers . | |
| 3,441,281 | 4/1969 | Pannwitz . | |
| 3,606,336 | 9/1971 | Krause | 273/272 |
| 4,383,689 | 5/1983 | Kohner et al. | 273/272 X |
| 4,690,409 | 9/1987 | Scalia | 273/299 |

*Primary Examiner*—Anton O. Oechsle

*Attorney, Agent, or Firm*—John M. Harrison

[57] ABSTRACT

A spinner device which is designed for use in a game that tests both the imagination and association of one or more players in the course of building a vocabulary. The spinner device is characterized by a frame or stand designed to pivotally receive a disc, wherein the disc is manually pivoted with respect to the frame to indicate a letter of the alphabet at random. An hourglass is also provided, in order to provide a means for timing the game sequences. When a letter of the alphabet is selected at random by spinning the disc, the hourglass is rotated to begin a game sequence and a player attempts to enunciate the largest number of words of which he is capable, beginning with the designated letter of the alphabet during the time sequence as determined by the hourglass.

20 Claims, 1 Drawing Sheet

SPINNER DEVICE

BACKGROUND OF THE INVENTION

1. Field of the Invention

This invention relates to a vocabulary-building, association word game and more particularly, to a spinner device which is characterized by a base or frame designed to rotatably receive a disc having the letters of the alphabet inscribed thereon, wherein initial rotation of the disc with respect to the frame and a pointer mounted on the frame and subsequent termination of disc rotation delineates a letter of the alphabet at random. After indication of this letter of the alphabet, an hourglass located on the frame is rotated 180° to begin a time sequence for innumerating various words, each beginning with the indicated letter of the alphabet. The game continues, with each player attempting to enunciate the largest number of words beginning with the letter of the alphabet chosen at random by spinning the disc and using the letter of the alphabet indicated by the pointer when the disc stops spinning.

2. Description of the Prior Art

Spinning disc pointers and like devices have long been used in games of chance for various purposes. An early such device is the "Game-Boards" detailed in U.S. Pat. No. 136,048, dated Feb. 18, 1873, to G. R. Elliott. The device is characterized by a round, roulette-type wheel provided with a spinning arrow in the center, whereby the arrow is spun in sequence by the players to designate certain areas of the game board for performance by the players. U.S. Pat. No. 1,060,998, dated May 6, 1913, to L. Moss, details a "Toy" which includes a box or casing adapted to be closed or opened by a hinged lid. A circular disc is rotatably mounted within the box and the exposed surface of the disc is divided into sections, in which is displayed the letters of the alphabet, numerals, animals or like subjects which will serve to interest as well as instruct a child. Rotation of the disc and closing of the lid causes the letters of the alphabet, numerals, animals or like subjects to be consecutively displayed through an opening located in the lid. U.S. Pat. No. 1,541,707, dated June 9, 1925, to Frank G. Hanback, details a "Game" which includes a base provided with various indicia and a disc pivotally mounted on the base for spinning by the players to indicate various indicia and elicit performance from the players in sequence. A rotating disc game device is detailed in U.S. Pat. No. 2,831,691, dated Apr. 22, 1958, to L. F. Vince. The device includes a stand provided with a large pivoting disc and a smaller fixed disc, the fixed disc of which is provided with the letters of the alphabet and the pivoting disc with radial lines extending to the center thereof. Numbers are provided on the pivoting disc and there is thus provided a relationship between the numbered sections of the fixed disc and the letter-containing segments of the larger pivoting disc, each finger affording a number and letter combination. In operation, the large disc is rotationally manipulated by hand and multiple different number and letter combinations are used to play the game. U.S. Pat. No. 3,163,426, dated Dec. 29, 1964, to M. J. Ruderian, details a "Power Toy Incorporating a Rotatable Disc Means for Providing Amusement". The power toy is provided with a rotating disc attached to a fixed member with multiple symbols circumferentially disposed about the axis of rotation of the disc. A marker in the form of a pointer is stationary and fixed to the fixed member, such that rotation of the disc by a player causes one of the plurality of symbols to be delineated by the pointer when the disc stops rotation. U.S. Pat. No. 3,226,122, dated Dec. 28, 1965, to F. E. Rogers, details a "Letter Selecting Device for Use in Word Building Game". The invention involves a letter arranging game which includes a flat sheet and a pattern of predetermined configuration on one side of the sheet, the pattern including a plurality of intersecting vertical and horizontal lines forming a rectangular array of rectangular spaces with respect to which the letters are to be arranged. Means are also provided for randomly selecting the identity of the letters of an alphabet to be arranged in the array, which means includes provision for making the frequency of selection of any particular letter generally proportional to the average frequency of usage of such letter in a language employing such alphabet. This is accomplished by rotating a wedge-shaped wheel and an outer rim, the wheel of which includes the letters of the alphabet and the rim provided with numbers. As the wheel is rotated, the respective letters of the alphabet correspond to numbers on the outer rim and the letter-number combination determines action by a particular player. A "Spinner Game Device" is detailed in U.S. Pat. No. 3,441,281, dated Apr. 29, 1969, to H. U. K. W. Pannwitz. The game spinner of the spinner game device includes a housing having a transparent top wall with a vertical spinner shaft journalled in the housing. Mounte on the shaft is a spinner disc which is provided at its peripheral margin with a series of consecutive numbers. A drive wheel is secured on the shaft and multiple friction driving cams are pivoted in the housing to engage and drive the drive wheel. The driving cams are provided with pinion gears, and meshing with each pinion gear are opposite rack pushbars slidably mounted in the housing peripheral wall and arranged so that they can be manually pushed inwardly to rotate their associated driving cams. An index wheel inscribed with a pointer is rotatably journalled relative to the spinner shaft and overlies the spinner disc. Multiple additional wheels marked with game data are also journalled for free rotation around the axis of the shaft. A method of playing a letter-selecting and arranging game is detailed in U.S. Pat. No. 4,690,409 dated Sept. 1, 1987, to A. Scalia. The game includes an indicator board provided with a pointer pivotally supported over a first dial face divided into sectors, each sector having indicia to identify an integer therein. Also included is a pointer pivotally mounted over a second dial face having at least twenty-six sectors, each sector including indicia to identify a letter of the alphabet. Letter indicia members corresponding to the letters identified in the second dial piece are manipulated by a player to form abbreviations, acronyms or initials.

It is an object of this invention to provide a spinner device which is used as a primary ingredient of a word game which increases one or more players' vocabulary.

Another object of the invention is to provide a simple, yet expedient spinner device for use in a word game which is educational and in which the words chosen for the game are based upon letters of the alphabet that are selected by chance using the spinner device.

Still another object of the invention is to provide a rotary spinner device for use in a word game which affords the capability of selection of words beginning with a randomly-selected letter of the alphabet and compiling a number of such words in a specified period of time.

Still another object of the invention is to provide a spinner device for use in a thought-provoking, vocabulary-building word game, which spinner device is characterized by a frame, a pointer fixed to the frame and a disc rotatably attached to the frame, with the letters of the alphabet provided in spaced relationship near the periphery of the disc, wherein the spinner can be manually rotated and a letter of the alphabet is aligned at random with the pointer when the disc stops rotating. A time sequence is initiated by rotating an hourglass 180° with respect to the frame and as many words beginning with the designated letter of the alphabet as a player is able to articulate within the specified time interval determined by the hourglass, are enunciated.

SUMMARY OF THE INVENTION

These and other objects of the invention are provided in a new and improved spinner device for use in a word game wherein the words are developed by individual player initiative within a specified time interval based on a letter of the alphabet which is determined by the spinner device. The spinner device is characterized by a frame, a shaft extending from the frame, a pointer upward-standing from the extending end of the shaft and a disc rotatably mounted on the shaft, with the letters of the alphabet provided adjacent to the periphery of the disc. An hourglass is pivotally attached to the frame, wherein the disc is rotated by the players individually in sequence, and upon alignment of a letter of the alphabet at random with the end of the pointer when the disc stops rotating, the hourglass is rotated 180° to begin a time sequence. The largest number of words beginning with the indicated letter of the alphabet are then articulated by a player within the time frame determined by the hourglass.

BRIEF DESCRIPTION OF THE DRAWING

The invention will be better understood by reference to the accompanying drawing, wherein.

DESCRIPTION OF THE PREFERRED EMBODIMENTS

Figure 1:
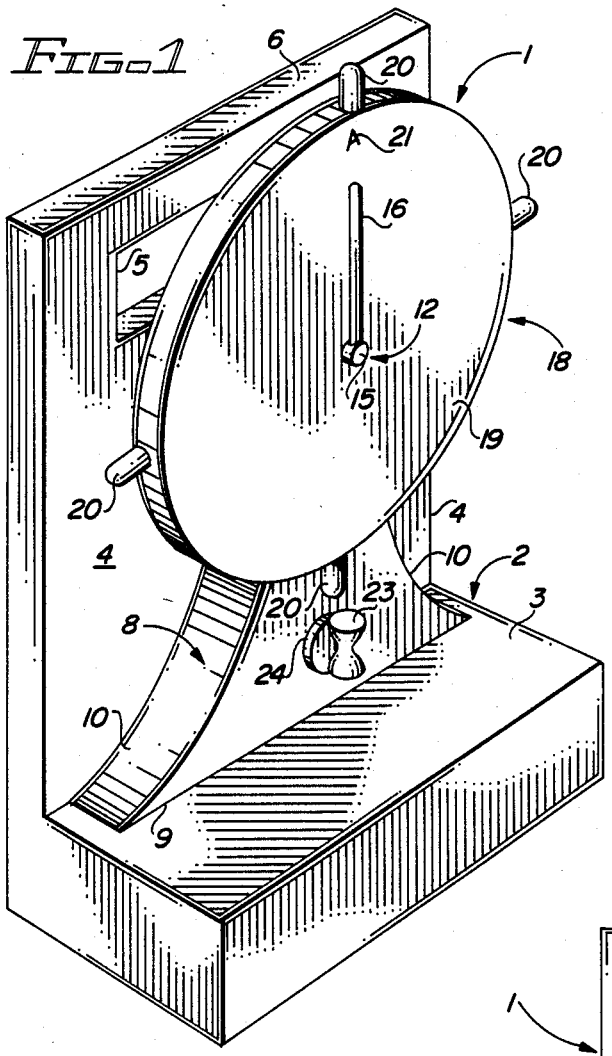
FIG. 1 is a perspective view of a preferred embodiment of the spinner device of this invention.
Figure 2:
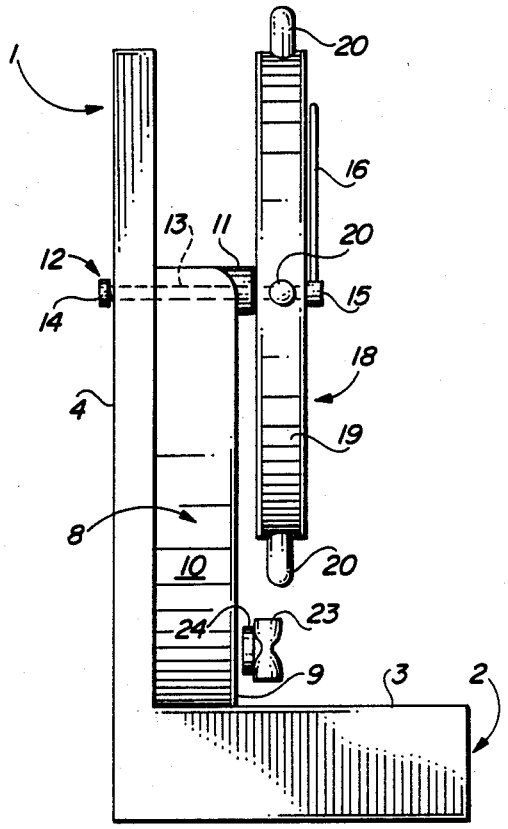
FIG. 2 is a left side view of the spinner device illustrated in FIG. 1.
Figure 4:
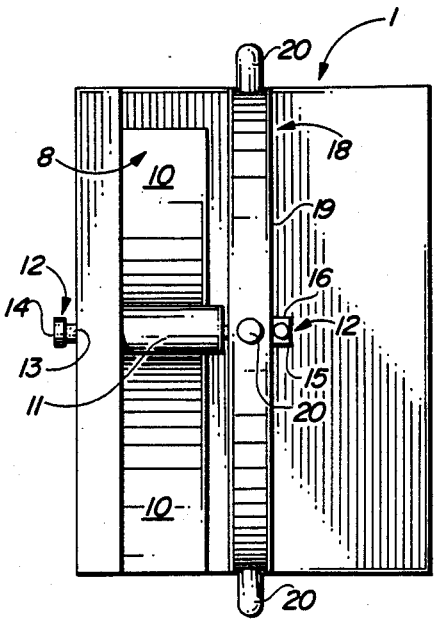
FIG. 4 is a top view of the spinner device illustrated in FIG. 1.
Figure 3:
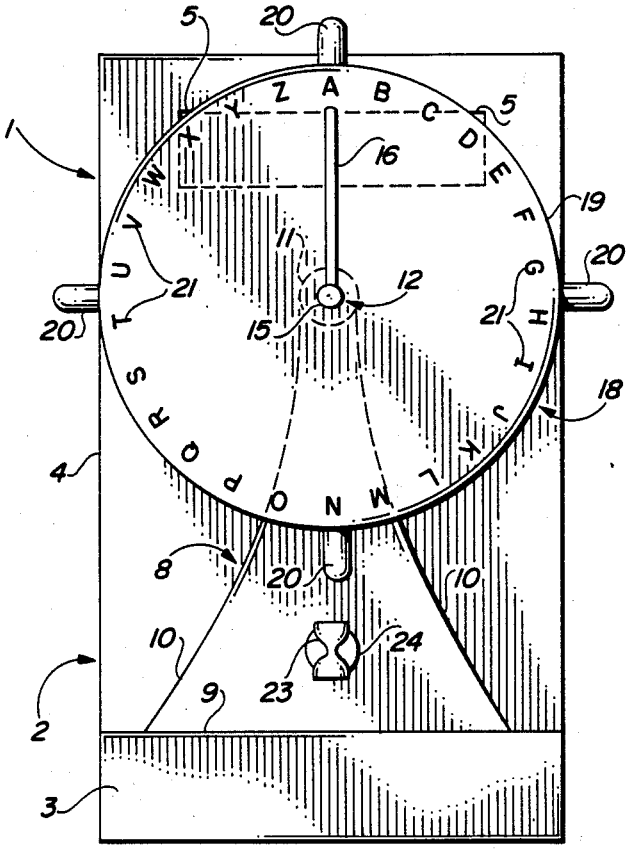
FIG. 3 is a front view of the spinner device illustrated in FIG. 1.

Referring to the drawing, the spinner device of this invention is generally illustrated by reference numeral 1 and includes an L-shaped frame 2, characterized by a horizontal base 3 and an upward-standing, vertical back 4. In a preferred embodiment, a handle slot 5 is provided in the back 4 near the top edge 6 thereof, for ease in carrying and using the spinner device 1. A spindle support 8 is secured to or formed integrally with the base 3 of the frame 2 at the support margin 9 and extends vertically upwardly, resting against and/or attached to the back 4. In a most preferred embodiment of the invention, the spindle support 8 curves at the sides from a maximum width at the support margin 9, to define curved support sides 10 which terminate at a spindle collar 11, which is horizontally mounted on the top of the spindle support 8, as further illustrated in FIGS. 2 and 4. The spindle shaft 13 of a spindle 12 projects transversely and horizontally through the back 4 and extends longitudinally through the spindle collar 11 and a spindle head 14 is provided on one end of the spindle shaft 13 adjacent to the back 4, while a pointer mount 15 is secured to or shaped integrally with the opposite end of the spindle shaft 13 and supports an upward-standing pointer 16, in fixed relationship. Accordingly, it will be appreciated from a consideration of FIGS. 2 and 4 of the drawing, that the spindle shaft 13 of the spindle 12 is horizontally and fixedly secured in the back 4 of the frame 2 and the spindle collar 11 to orient the pointer 16 in fixed, upward-standing, vertical relationship. A disc 18 is rotatably mounted on the extending end of the spindle shaft 13 between the forwardly-projecting end of the spindle collar 11 and the pointer mount 15, as further illustrated in FIGS. 2 and 4. The disc 18 is characterized by a round disc plate 19 and in a preferred embodiment of the invention, plate grips 20 extend outwardly from the periphery of the disc plate 19 in equally spaced relationship. As illustrated in FIG. 3, plate letters 21, which are characterized by letters of the alphabet, are provided in spaced, clockwise fashion adjacent to the periphery of the disc plate 19. As further illustrated in FIGS. 1-3 of the drawing, an hourglass 23 is pivotally attached to the spindle support 8 beneath the disc 18 by means of an hourglass plate 24, to facilitate rotation of the hourglass 23 in a 180° relationship and periodically cause a flow of sand (not illustrated) provided in the hourglass from a first compartment through the hourglass neck to a second compartment, in conventional fashion.

Referring again to the drawing, in a preferred embodiment of the invention the word game is played under the title "Think Twice", using the spinner device 1 as follows. A player initially spins the disc 18 by grasping or applying pressure to one of the plate grips 20, such that the plate letters 21 located on the disc plate 19 traverse the fixed pointer 16. When the disc 18 comes to rest, the end of the pointer 16 lies adjacent to one of the plate letters 21, for example the letter "A", as illustrated in FIG. 3. The hourglass 23 is then rotated 180° to initiate the passage of sand through the hourglass neck, thus beginning a time sequence in which the player must enunciate the greatest number of words beginning with that letter of the alphabet of which he is capable, within the time frame established by the hourglass 23. When the time period as determined by the hourglass has elapsed, the disk 18 is spun by another player and the process is repeated using the letters of the alphabet chosen at random by spinning the disc 18.

Various other embodiments of the "Think Twice" word game are possible using the spinner device 1. For example, the player or players may be called upon to enunciate only nouns which begin with a plate letter 21 of the alphabet as determined by the spinner device 1. Alternatively, only words which are not nouns may be specified by the players for enunciation during the predetermined time sequence. If any word is repeated by a player it may not be included at all in the total, or it must be subtracted from the total, as desired. Another variation of the "Think Twice" game is the enunciation by the players in sequence of words beginning with successive plate letters 21 of the alphabet, starting with a plate letter 21 determined by the spinner device 1. Other variations in the "Think Twice" word game of this invention will be apparent using the spinner device 1 disclosed herein.

It will be appreciated by those skilled in the art that the spinner device and word game of this invention operate to increase the vocabulary and mental ability of the players, since the letter-initiated words must be enunciated within a specified time sequence. The game is of significant educational benefit and offers an exciting and interesting technique for increasing the vocabulary and developing the art of quick thinking.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A spinner device for use in a word game, comprising a support; disc means provided with letter indicia on one face thereof, said disc means rotatably carried by said support; indicator means fixedly attached to said support, said indicator means projecting across at least a portion of said one face of said disc means; and an hourglass rotatably carried by said support, whereby rotation of said disc means causes said letter indicia to rotate past said indicator means in a circular path and one of said letter indicia aligns with said indicator means when said disc stops.

2. The spinner device of claim 1 wherein said disc means further comprises a spindle fixedly attached to said support and a round disc plate rotatably carried by said spindle.

3. The spinner device of claim 2 wherein said indicator means is fixedly secured in upward-standing relationship to said spindle.

4. The spinner device of claim 2 wherein said letter indicia further comprises the letters of the alphabet arranged in clockwise relationship on said disc plate.

5. The spinner device of claim 4 wherein said indicator means is fixedly secured in upward-standing, substantially vertical relationship to one end of said spindle.

6. The spinner device of claim 1 further comprising a handle slot provided in said support for handling said spinner device.

7. The spinner device of claim 6 wherein said disc means further comprises a spindle fixedly attached to said support in substantially horizontal relationship and a round disc plate rotatably carried by said spindle.

8. The spinner device of claim 7 wherein said indicator means is fixedly secured in upward-standing, substantially vertical relationship to one end of said spindle.

9. The spinner device of claim 8 wherein said letter indicia further comprises the letters of the alphabet arranged in clockwise relationship on said disc plate.

10. The spinner device of claim 1 wherein said support further comprises a base and a back upward-standing from said base and further comprising a spindle support carried by said base and a spindle fixedly secured to said spindle support.

11. The spinner device of claim 10 wherein said disc means further comprises a round disc plate rotatably carried by said spindle and said hourglass is rotatably attached to said spindle support.

12. The spinner device of claim 11 wherein said indicator means is fixedly secured in upward-standing, substantially vertical relationship to said spindle.

13. The spinner device of claim 12 further comprising a handle slot provided in said back and wherein said letter indicia further comprises the letters of the alphabet arranged in clockwise relationship on said disc plate.

14. A spinner device for randomly indicating various letter indicia in a word game, said spinner device comprising a base; back means upward-standing from said base; a spindle fixedly carried by said back means in spaced relationship with respect to said base; a pointer projecting from said spindle in fixed relationship; a disc rotatably disposed on said spindle between said back means and said pointer; letter indicia provided on said disc in spaced relationship; and an hourglass pivotally attached to said back means, whereby rotation of said disc on said spindle causes said letter indicia to rotate past said pointer in a circular path and one of said letter indicia aligns with said pointer when said disc stops.

15. The spinner device of claim 14 wherein said letter indicia further comprises the letters of the alphabet arranged in clockwise sequence on said disc plate.

16. The spinner device of claim 14 wherein said back means further comprises a back member upward-standing from said base and a spindle support carried by said base adjacent to said back member and further comprising a spindle collar carried by said spindle support in substantially horizontal relationship, for supporting said spindle in fixed relationship.

17. The spinner device of claim 16 further comprising a handle slot provided in said back member for handling said spinner device.

18. The spinner device of claim 16 wherein said letter indicia further comprises the letters of the alphabet arranged in clockwise sequence on said disc plate and further comprising a handle slot provided in said back member for handling said spinner device.

19. The spinner device of claim 14 wherein said letter indicia further comprises the letters of the alphabet arranged in clockwise sequence on said disc plate, said back means further comprises a back member upward-standing from said base in substantially perpendicular relationship, a spindle support carried by said base adjacent to said back member and further comprising a spindle collar carried by said spindle support in substantially horizontal relationship for supporting said spindle in fixed, substantially horizontal relationship and a handle slot provided in said back member for handling said spindle device.

20. A spinner device for randomly indicating various letters of the alphabet in a word game, said spinner device comprising a horizontal base; a back member upward-standing from said base in substantially vertical relationship; an upward-standing spindle support fixedly carried by said base and a spindle collar fixedly carried by said back and said spindle support in spaced, substantially horizontal relationship with respect to said base; a pointer upward-standing from one end of said spindle in fixed, substantially vertical relationship; a disc rotatably disposed on said spindle between said back and said pointer; letters of the alphabet provided on one face of said disc in spaced relationship; and an hourglass pivotally attached to said spindle support, whereby rotation of said disc on said spindle causes said letter indicia to rotate past said pointer in a circular path and one of said letter indicia aligns with said pointer when said disc stops.

* * * * *